United States Patent [19]

Depka

[11] 3,989,432

[45] Nov. 2, 1976

[54] MEANS FOR SLUMPING CEMENT BLOCKS

[75] Inventor: Charles W. Depka, Carlsbad, Calif.

[73] Assignee: Modern Builders Supply Co., Oceanside, Calif.

[22] Filed: Feb. 18, 1975

[21] Appl. No.: 550,466

[52] U.S. Cl. ..... 425/139; 425/150; 425/422; 425/424; 425/443; 425/444

[51] Int. Cl.[2] ..... B28B 3/08; B28B 13/05

[58] Field of Search ..... 425/139, 141, 150, 255, 425/424, 432, 443, 444, 422

[56] References Cited

UNITED STATES PATENTS

| | | | |
|---|---|---|---|
| 2,298,446 | 10/1942 | White | 425/424 |
| 2,464,641 | 3/1949 | Hearin, Jr. | 425/424 |
| 2,612,658 | 10/1952 | Sayre | 425/444 |
| 2,957,222 | 10/1960 | Zmania et al. | 425/219 |
| 3,264,702 | 8/1966 | Clanton et al. | 425/443 |
| 3,545,053 | 12/1970 | Besser | 425/150 |
| 3,679,340 | 7/1972 | Springs | 425/424 |
| R25,404 | 6/1963 | Wellnitz | 425/441 |

*Primary Examiner*—Francis S. Husar
*Assistant Examiner*—John McQuade
*Attorney, Agent, or Firm*—Duane C. Bowen

[57] ABSTRACT

During stripping of a cement block from a mold in a cement block forming machine by shoes of a stripper head, the head is driven by gravity and its distance from a pallet receiver structure, including a pallet receiving the cement block, is limited by hydraulic, collapsible stops. The stops collapse during stripping a distance sufficient to slump the block. The amount of collapse during the stripping time interval is controlled by adjustable hydraulic flow means under constant pressure.

2 Claims, 10 Drawing Figures

MEANS FOR SLUMPING CEMENT BLOCKS

BRIEF SUMMARY OF THE INVENTION AND OBJECTIVES

My invention relates generally to means for improved slumping of cement blocks and, more particularly, to hydraulic, collapsible stops controlling closing movement between block stripping head shoes and a block receiving pallet so that the block is compressed sufficiently to produce the right amount of slumping during the stripping time interval.

My invention applies particularly to a Besser Vibrapac, a product of the Besser Company of Alpena, Michigan, or to any other similar cement block forming machine which may have such structure and operation as to make the present invention, as shown and described, applicable, as will be understood by those skilled in the art.

As far as I know, others using Besser machines to slump blocks have not done this during stripping of the block, successfully if at all, but rather have slumped later at a location somewhat removed from the stipping location. Slumping during stripping is advantageous for various reasons including greater plasticity of the cementitious material forming the block, so that slumping can be more extensive and the rejection rate due to block malformation can be lower than if the slumping were not done during stripping. An object of my invention is to conduct slumping of cement blocks during stripping.

The Besser type stripping process in which the stripper head is driven by gravity during stripping is more adaptable to the practice of my invention than other types, such as the Columbia Block Machine (Columbia Machine Company, Vancouver, Washington) in which the stripping is accomplished with hydraulic pressure, for reasons such as problems of control of hydraulic pressure, and it is an object of my invention to provide slumping means adapted for the Besser type machine above described.

Further objects of my invention include (a) to provide an adjustable system for slumping blocks that will be readily adapted to changes in the weather and changes in the mix, both as to changes from one mix to another and changes in plasticity during use of a single mix, (b) to provide such a system of hydraulic nature and, more particularly, one controlled by an adjustable flow control valve under constant hydraulic pressure, (c) to devise a system which has low cost, high reliability, and low maintenance and which operates rapidly and effectively, and (d) to provide a system producing a greater degree of slumping while reducing block malformation rejection, compared to prior processes in the field.

My invention will be best understood, together with additional objectives and advantages thereof, from the following description, read with reference to the drawings, in which.

Figure 1:
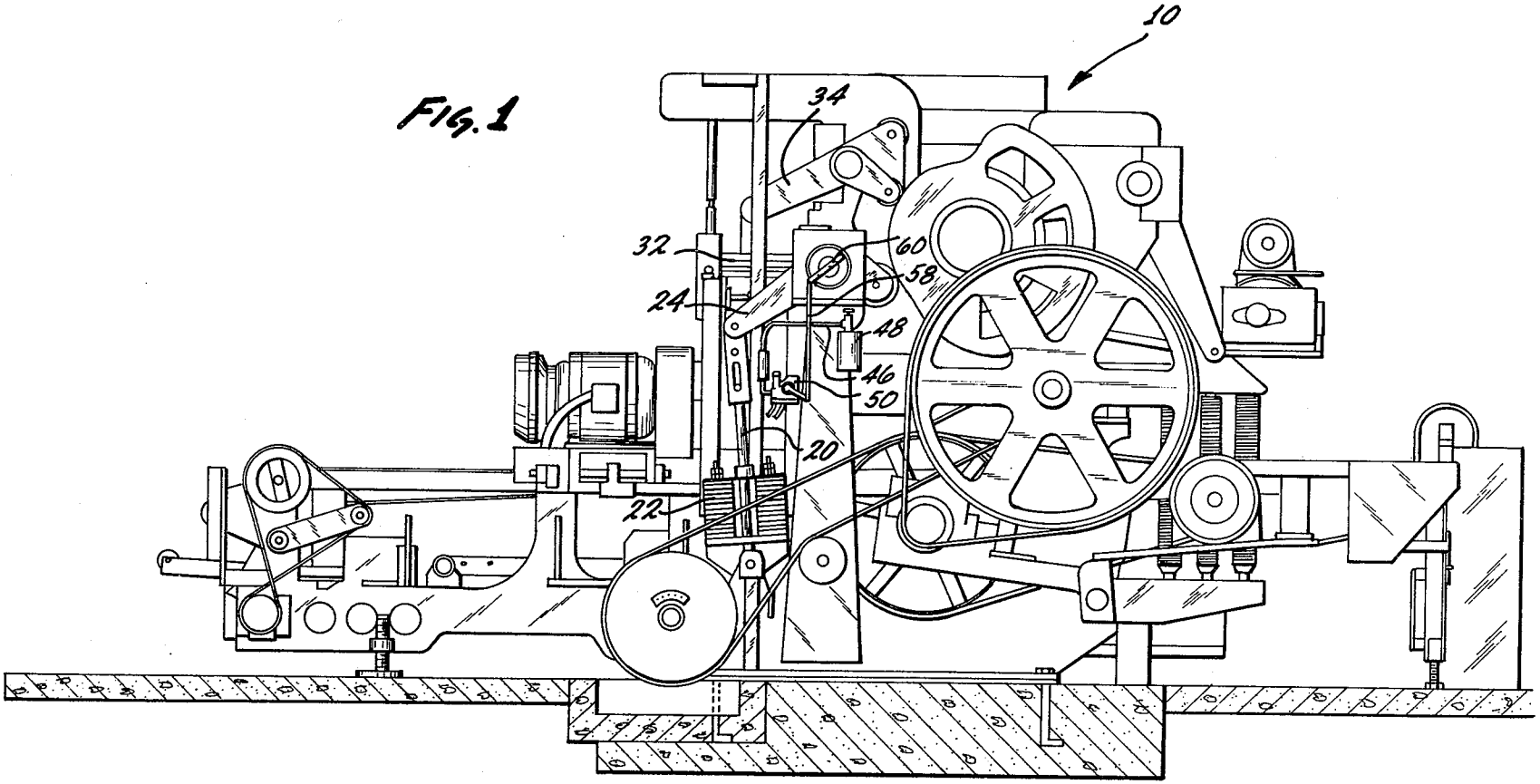
FIG. 1 is a side view of a machine built like a Besser Vibrapac and modified by a specific embodiment of my invention.

The drawings and description are addressed to those skilled in the art and thoroughly familiar with Besser block machines. I will limit description of structures and operations that are within their knowledge, in order to avoid undue detail in the drawings and description, and I am sure they will understand my invention with even less detail as my system is essentially uncomplicated.

I will define "slumping" although this term is familiar to those skilled in the art. It is to take a block shape that otherwise would be a precision block and to compress it on its vertical axis so as to cause the outer walls to bow outwardly. Such slumped blocks with curved exposed surfaces often make more interesting and decorative building walls than precision blocks ("precision" blocks meaning normal right-rectangular blocks). The appearance is somewhat like adobe brick walls. In general, the more curved the exterior walls of the slumped walls the more interesting and decorative the building wall and to the best of my knowledge the slumped blocks produced with my process have more pronounced curvatures to walls than have been produced by others with different processes. To give an example, the width, height and length of one side of two-core blocks in my process in the mold before slumping is about 7⅛ × 4¼ × 14⅞ inch and after slumping is about 7½ × 3½ × 15½ . This would be a block that in precision forming would be nominally 8 × 4 × 16 inch. The figures of the example are not precise but are indicative. In general the exterior walls of a block in my process, in what would be a nominally 4 inch high precision block without slumping, each bulge or roll about ¼ inch, whereas the blocks in other processes I believe usually only bulge or roll about ⅛ inch as to each exterior wall. The reduction in block height in the example during slumping is about ¾ inch in my process, whereas the blocks in other processes, to the best of my knowledge, only reduce about ¼ inch in the same type of block. It will be understood that the block height during slumping has to reduce more in able to produce more slumping because the material forming the building walls is obtained from the material that otherwise would produce more height in the block.

I will specifically describe my invention in three steps: (a) a general orientation of the invention to the Besser Vibrapac as partly illustrated, (b) a description of the collapsible hydraulic stop and its relationship to other parts of the block making machine, and (c) a specific desription of parts intimately involved in slumping a block as diagrammatically illustrated.

General Orientation

As before indicated, the cement block making machine 10 depicted follows the construction of a Besser Vibrapac. A mold 12 is supported in the machine, having vertical core openings therethrough. It will be understood that the contour of the mold vertical core openings correspond in horizontal cross-section to the horizontal cross-section of cement blocks that are formed, and that block heights are determined by various factors including the vertical height of the vertical core openings, the depth they are filled with a cementitious mixture, reduction in height of the mixture particularly due to vibration, compacting due to the action of the stripper head shoes thereon, and the pre-set limit on the minimum distance between the shoes and the pallet supporting the block being formed.

Metal plate pallets receive blocks stripped from mold 12 and are supported by a pallet receiver frame 14 with upstanding plates 16 having pallet receiving rubber mounts 18 on top to support the pallets. Frame 14 is moved vertically during a block forming cycle so that the pallet supports the blocks as they are stripped from mold 12 by means including links 20 and springs 22. Links 20 are pivotally connected to arms 24 that are pivotally mounted on a shaft. It will be understood that during a cycle in forming a block, arms 24 pivot and frame 14 moves up and down to move the pallet to support the bottom surface of the block being stripped from mold 12. As all of the foregoing and other structure and operation follows present machines and practices, no further detail needs to be given.

Figure 2:
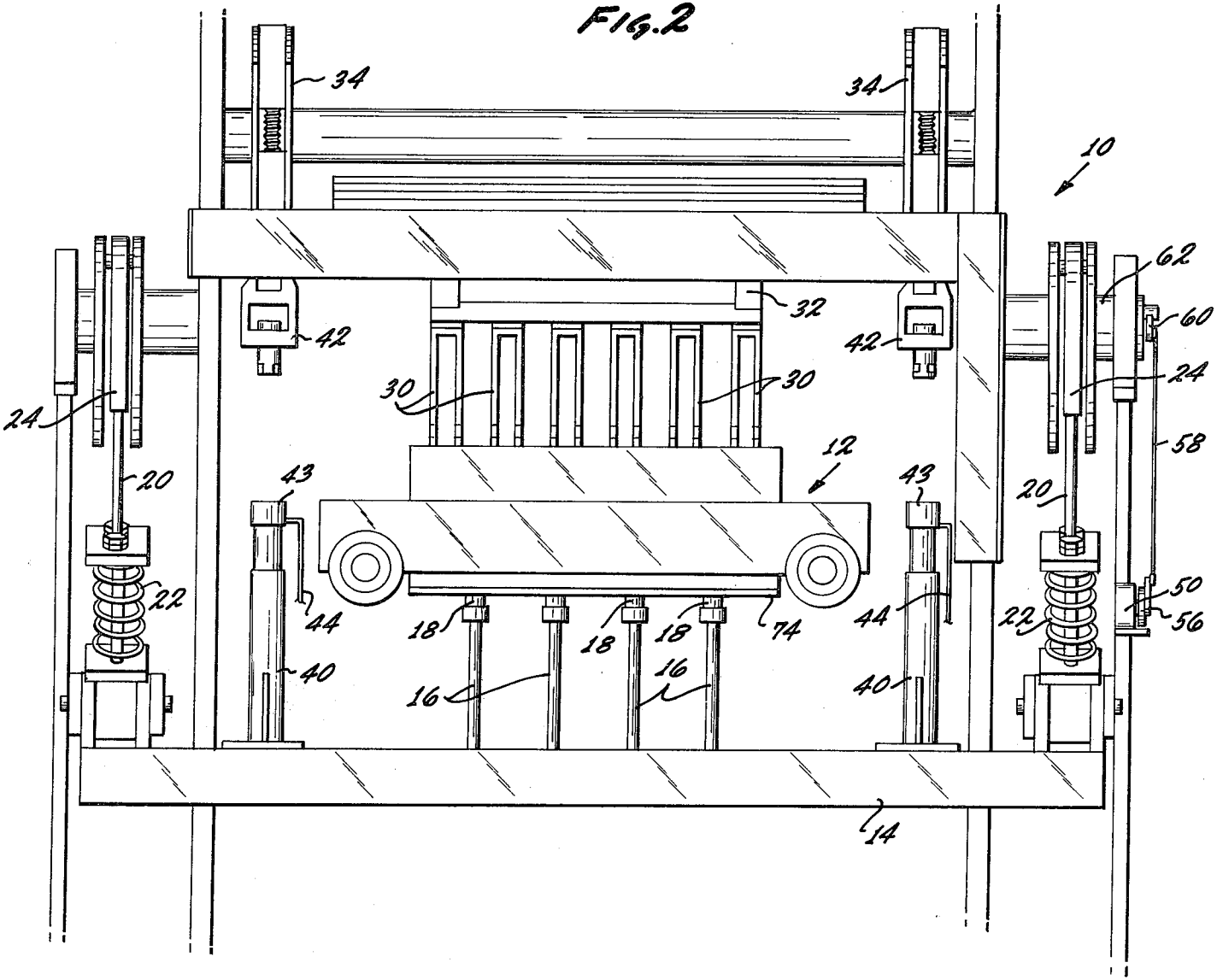
FIG. 2 is a front of portions of the machine on an enlarged scale at a point early in the machine block making cycle.
Figure 3:
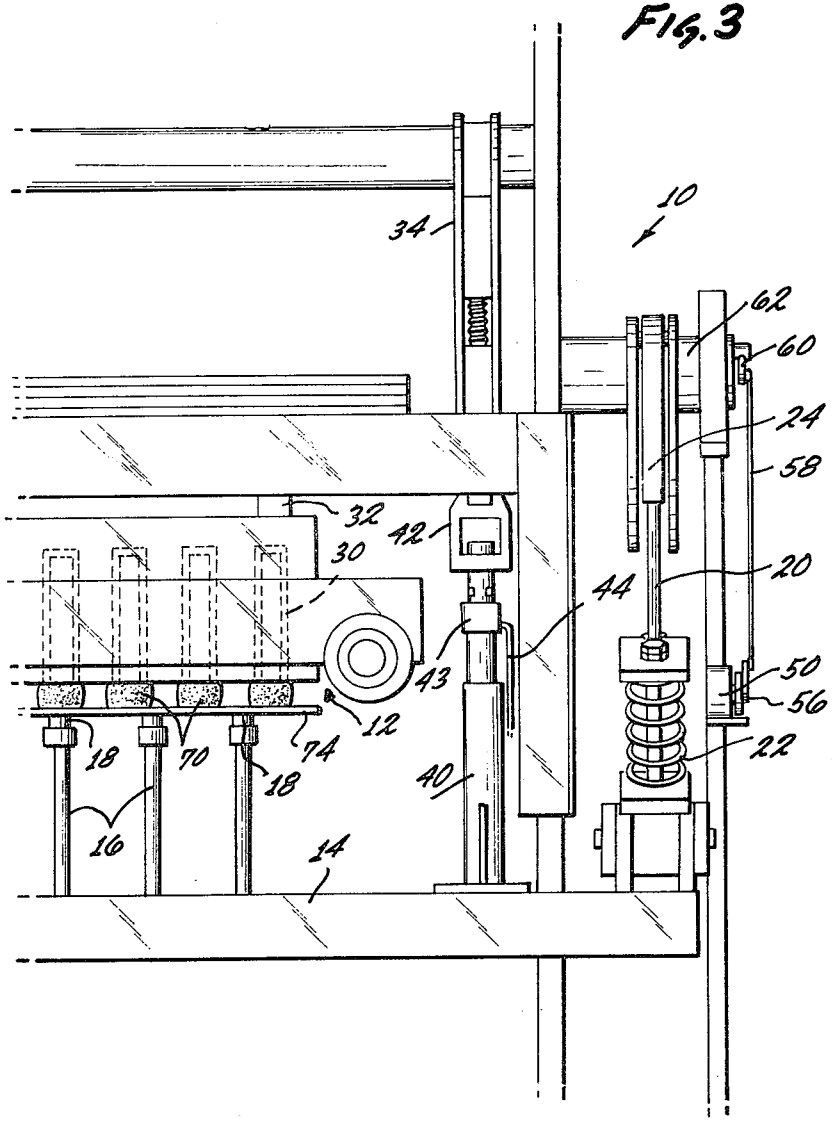
FIG. 3 is like FIG. 2 only showing a smaller section of the machine and taken at a point in the machine block making cycle when block stripping is substantially completed.
Figure 4:
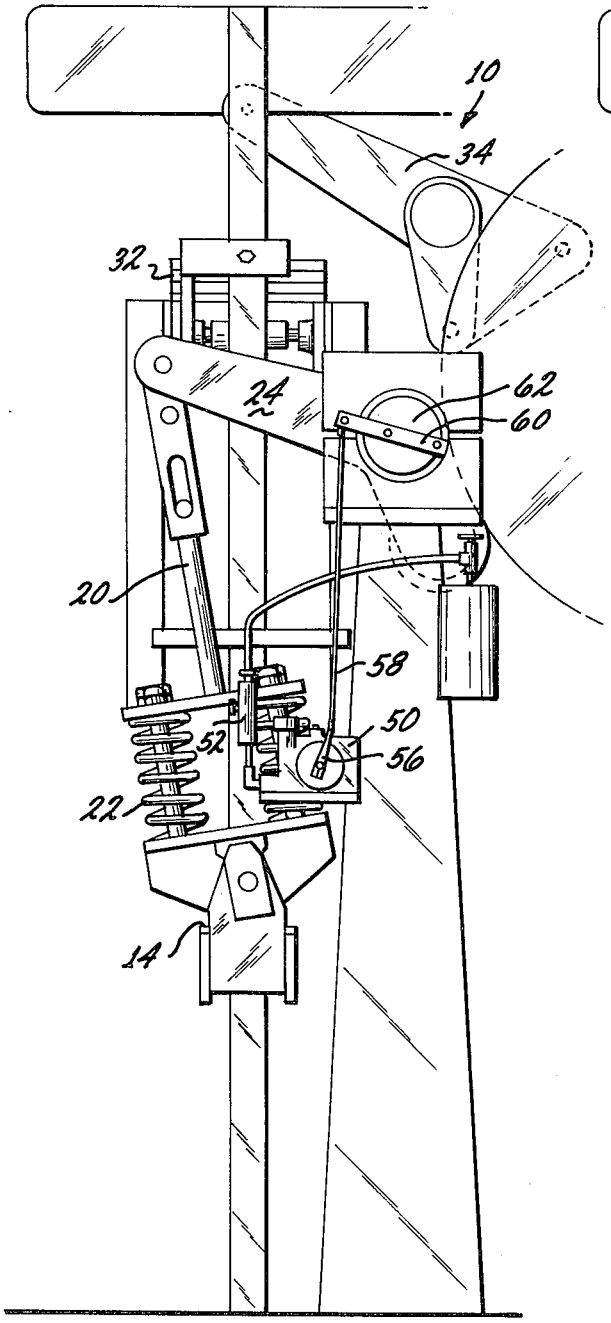
FIG. 4 is a side view of portions of the machine early in the cycle.
Figure 5:
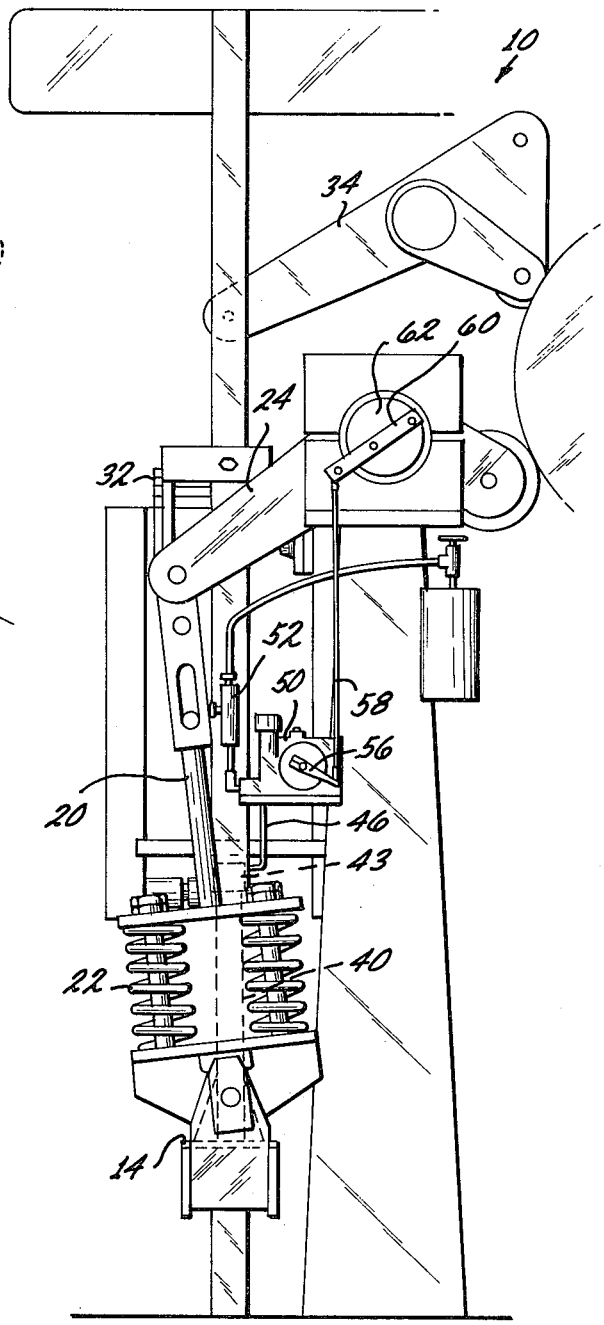
FIG. 5 is like FIG. 4 only being taken later in the cycle.

To briefly describe the stripper head assembly, stripper shoes 30 depend from a head assembly 32 and move during the cycle of operation from a position above mold 12 to a lower position forcing the cementitious material out of the bottom of the mold. FIG. 2 shows shoes 30 in an upper position and FIG. 3 shows shoes 30 in a lower block-stripping position. Likewise, FIGS. 2 and 4 show pallet received frame 14, plates 16 and rubber mounts 18 in an upper position before the blocks have started to strip from the mold, whereas FIGS. 1, 3 and 5 show the same structure in a lower position during block stripping. The head structure and the pallet receiver structure move somewhat together during block stripping.

Head assembly 32 is supported from arms 34 that are pivotal about a shaft. Head assembly arms 34, pallet arms 24 and other parts are variously moved or controlled in their cycles of movement during block forming by a cam shaft, cams thereon, cam followers, etc. Some of these are depicted in the drawings but will not be detailed because they follow the standard construction and operation of the Besser Vibrapac and the present description would be unnecessarily lengthened by reviewing such parts and operations. It should be observed, however, that although operation of the head assembly 32 is controlled or powered by cams, the head assembly basically descends by the force of gravity. Although this is part of the design of the Besser Vibrapac, it is also essential to the operation of my invention, and may be distinguished from the head operation of the Columbia block machine, which instead is hydraulically operated.

Collapsible Hydraulic Stop

Figure 6:
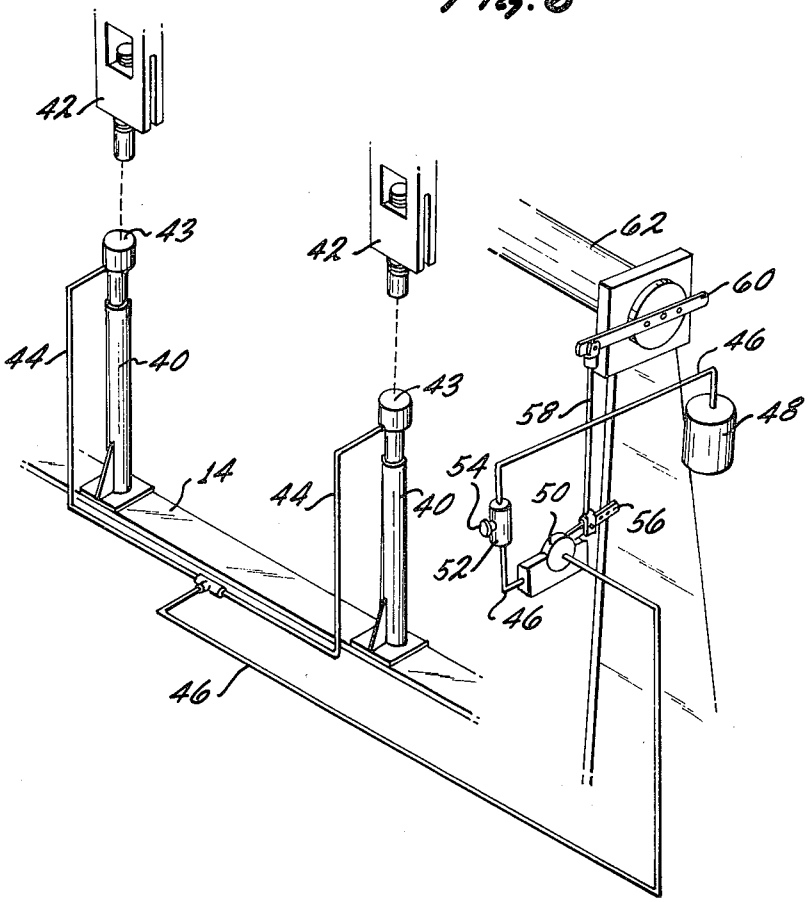
FIG. 6 is a perspective view of portions of the machine and particularly of the collapsible hydraulic stop system.

FIG. 6 is particularly devoted to the general collapsible hydraulic stop system. In the standard Besser installation, adjustable height fixed stops for spacing of the head assembly 32 from the pallet assembly during descent of the stripper head are provided somewhat like the stop members 40, upstanding from pallet receiver frame 14 as depicted in FIG. 6. The prior stop structure differed, however, by being of fixed height (rather than being collapsible). Incidentally, the prior stop structure also incorporated electrical switching means at the top of members 40 which, upon contact of head stop members 42, were operative to stop the machine vibratory mechanisms that act on the cementitious material in the mold vertical cores to compact the same in making precision blocks. This switching mechanism is eliminated in my stop system and instead I control the termination of vibration by the machine vibration timer. Further, I stop vibration earlier (before head members 42 contact stops 40) in making slump blocks, rather than precision blocks. That is because the cementitious material will be too compacted for good slumping if vibration continues as long as in making precision blocks, and I prefer to stop vibration about as soon as the mold is filled. Note will be made that head members 42 are indicated as having screw adjustment, but that is standard on Besser Vibrapacs so it will not be detailed.

The upper portion 43 of stop members 40 are suitably formed in the nature of hydraulic piston-cylinders. I won't detail this structure, as it can be variously formed, except to say that the top 43 of the stop member 40 can collapse or descend relative to pallet receiver frame 14 to the extent that hydraulic fluid is permitted to escape through lines 44 connected thereto.

Lines 44 join to line 46 which leads to accumulator 48 (which may be maintained at about 80 psi pressure). Interposed in line 46 is a rotary on-off control valve 50 and a flow control valve 52 that is readily adjustable during a block forming run by a knob 54. Rotary control valve 50 is operated (to permit or not permit flow through line 46) by a valve arm 56, a pivotally mounted link 58, and an arm 60 connected to the pallet receiver shaft 62. The rotary valve control system is designed to open line 46 when the head stripper shoes 30 are about one-third of the way down through the vertical cores in mold 12 and to remain open until some time after the head assembly 34 strikes head stops that limit descent of the head as the pallet receiver structure continues on down around two inches to a level where the pallet (with the newly formed blocks thereon) can be conveyed out of the machine. It will be understood that valve 50 must be left open until some time after the head assembly 32 no longer rests on the pallet receiver assembly (after head stop 42 no longer rests on hydraulic stop 43) so that the pressure from accumulator 48 can direct flow in the reverse direction through line 46 to restore hydraulic stop 43 on stop member 40 to its original position ready for the next cycle.

I will later more specifically describe the action of stripper head shoes 30 in the vertical cells of mold 12. In general, slumping occurs when hydraulic stop 43 collapses. This means that instead of shoes 30 having a fixed distance from the block supporting pallet during the cycle stripping blocks from mold 12 (which is the case with the non-collapsible stop members 40 used before in making precision blocks), in my formation of slump blocks shoes 30 are permitted to become closer to the pallet (by collapse of stops 43) in order to slump the blocks. The slumping occurs between the time rotary valve 50 is opened (when shoes 30 are preferably about one-third of the way down in the mold cores) and the time the head assembly 34 strikes head stops after the blocks have cleared mold 12.

The amount of slumping depends on how much shoes 30 close toward the pallet in the time available (a fraction of a second) and this is determined by the setting of flow control valve 52. If valve 52 is closed (and the timer adjusted), precision blocks can be made with the assembly, as stop structure 40, 43 then acts as non-collapsible stops. The amount valve 52 is opened in forming slump blocks depends on the judgement of the operator. Adjustment has to be made for a number of factors, i.e., differences in aggregates, the relative humidity and other climatic factors, the mix of cementitious materials, and the progress of the run with the mix. Adjustment may be made as much as four or five times or more during a run as the mix changes due to time since it was made (due to drying, loss of air, etc.). Although control will be attempted to standardize the mix and the additions of air-entraining agent, plasticizer, accelerator, etc., the adjustment of valve 52 will depend on operator experience and observation. A general note on the mix is that it should be wetter than in making precision blocks. Those skilled in the art will be able to adjust mixes and to learn to control valve 52 properly, but there is nothing that can be given as to standardized mix formulations or as to settings of valve 52 in this description as there are too many variables and too many determinations to be made on the basis of operator experience, preferences, prejudices and judgements, i.e., changes need to be made on the basis of relative humidity and the aggregate available, an operator will prefer a wetter or dryer mix or will prefer more air-entraining agent, etc.

From the foregoing, it is believed that those skilled in the art will have no difficulty in fabricating, installing or using the collapsible hydraulic stop system illustrated particularly in FIG. 6.

Diagrams on Block Slumping

FIGS. 7 to 10 represent the sequence of operations in forming and slumping a block 70. The figures are diagrammatical and do not represent actual constructions and dimensions, but the views could represent a cross-section across the width of, for example, a two cell block, of which one cell 72 is seen. Usually the mold 12 will produce more than one block side-by-side in a single operation, but only one block 70 is viewed in these figures.

Figure 7:
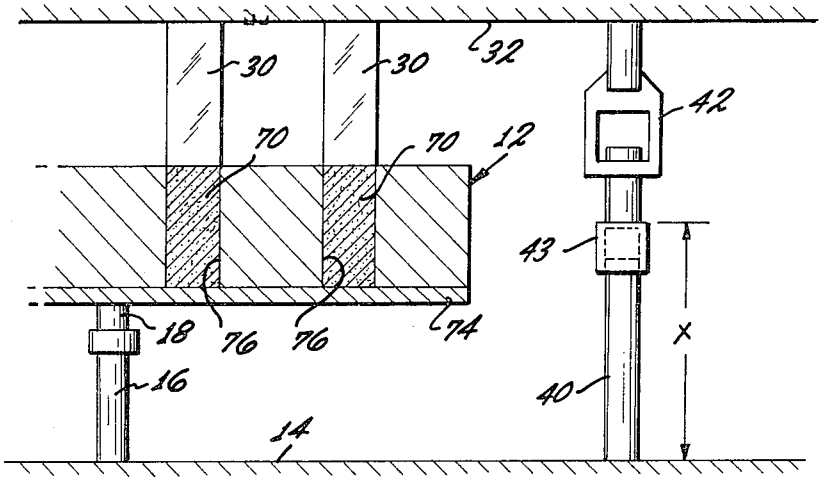
FIG. 7 is a diagrammatical view, partly in section, showing stripping head shoes, mold, pallet and hydraulic stop mechanism before block stripping has started.

Mold 12 has been filled with a cementitious mixture in FIG. 7 and is supported at the bottom by a pallet 74 (which would be supported by the rubber pads 18 on plates 16 on pallet receiver frame 14 as shown in other views). The shoes 30 of the stripper head 32 have just started to enter the vertical cores 76 of mold 12. The upper head stop member 42 of head assembly 32 is abutted to the hydraulic stop 43 of the lower support members 40 mounted on pallet receiver frame 14. Rotary valve 50 has not yet been opened and the stripper head can not move closer to pallet 74 as they descend together because hydraulic pressure can not escape from the hydraulic cylinder, although, otherwise, head 32 under the force of gravity would descend relative to pallet 74.

Figure 8:
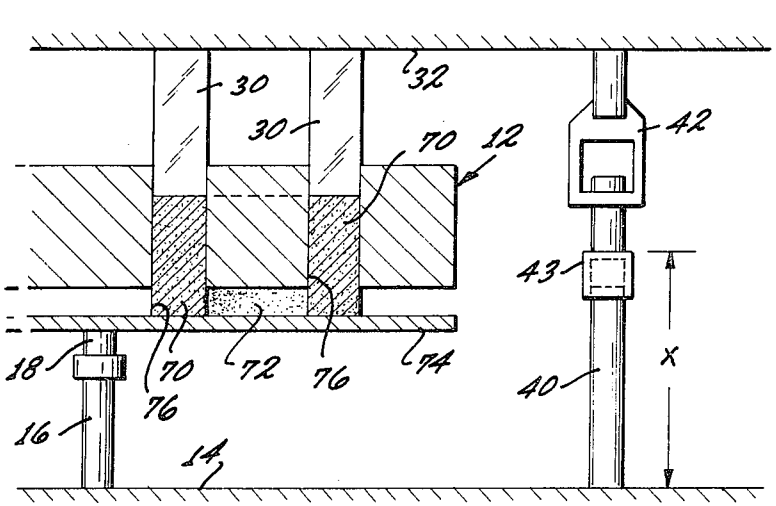
FIG. 8 is like FIG. 7 only the block has been stripped about one-third from the mold.

In FIG. 8, shoes 30 have moved some distance, such as a third of the way, into vertical cores 76 of mold 12 and block 70 has been stripped that much from the mold and the lower surface of the block is supported by pallet 74. The extruded portion of block 70 at this point has substantially the shape of a precision block. The spacing of shoes 32 to pallet 74 is the same as in FIG. 7 and the view of FIG. 8 is meant to represent about the instant when valve 50 is opened. The distance value "*x*" in FIGS. 7 and 8 is meant to indicate that the hydraulic stop 43 has not started to collapse.

Figure 9:
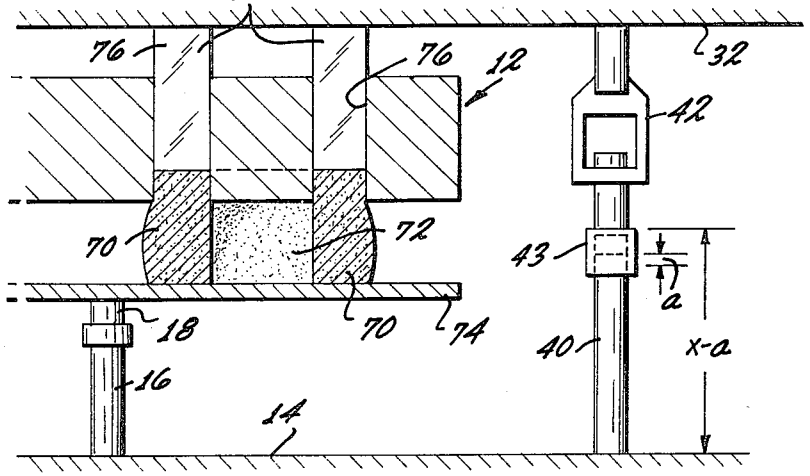
FIG. 9 is like FIG. 7 only the block has been stripped about two-thirds from the mold.

In FIG. 9, shoes 30 have moved a further distance, such as two-thirds of the way, into mold vertical cores 76 of mold 12 and block 70 has been stripped that much from the mold. Hydraulic line 46 is now open permitting stop 43 to collapse a distance "*a*" so that the former distance "*x*" becomes the distance "*x-a*". That distance depends on the setting of flow control valve 52 and the time interval between the FIG. 8 and FIG. 9 positions, which is a small fraction of a second. The extruded portion of the block 70 has now been bulged or slumped as to its exterior walls, because shoes 32 are now closer to pallet 74 than they were in the FIG. 8 view.

The reason to start slumping the block before it leaves cores 76 is to obtain a generally symmetrical curve (sometimes called "roll" in the trade) to the exterior walls (which ultimately may bulge a maximum distance of about ¼ in a 3½ inch high block in my process). If slumping awaited complete stripping of the block 70 from mold cores 76, the pressure, applied on the top, would tend to bulge the upper walls more than the lower walls (as the head is accelerating relative to the pallet) resulting in an unsymmetrical curve to the walls. This is not to say that the curve in my process is exactly symmetrical, but it is generally symmetrical, although I am able to slump the walls farther than I have observed in other party's blocks, i.e., perhaps slumping the walls ¼ inch in my process instead of ⅛ inch or less in other processes and reducing block height, for example, from 4¼ inch to 3½ inch during the slumping cycle in my process instead of from 3¾ inch to 3½ inch in other processes. These values for the slumped blocks of various other parties may not be correct, and I don't want to be held to them, but the values given reflect the information available to me.

The inner walls of block 70 (the walls of cell 72) do not slump very much. This is apparently because the four walls forming a cell support each other so that slumping occurs mostly in the unsupported exterior walls (side and end walls). The process, however, works with "C" blocks in which an interior cell may be only supported by three walls. The drawings exaggerate the slumping for clarity of illustration and, as indicated, the slumping may be one-fourth inch as to each exterior wall of a 3½ inch high block 70.

Figure 10:
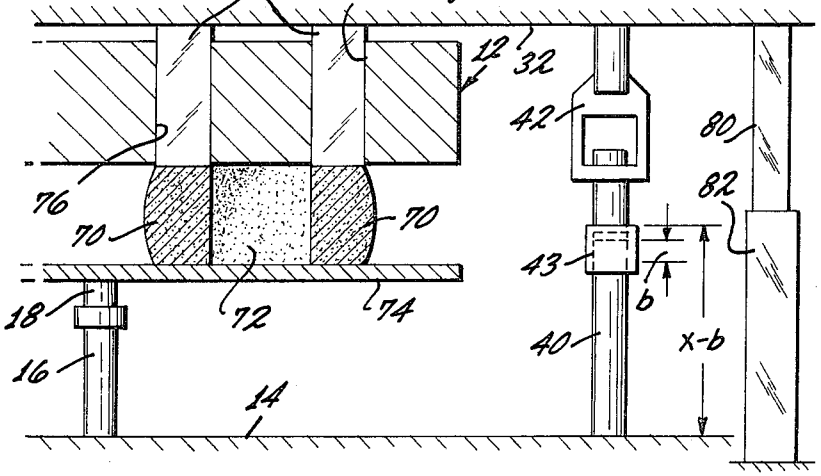
FIG. 10 is like FIG. 7 only the block has been completely stripped from the mold and the view also indicates a stripper head stop assembly.

In FIG. 10, block 70 has been completely stripped from the cores 76 of mold 12 and shoes 30 have further slumped block 70 (producing generally a symmetrical curvature) by moving closer to pallet 74. The further collapse of hydraulic stop 43 is illustrated by the value "*x-b*" in which "*b*" is greater than the distance "*a*" in FIG. 9. Near this point in the cycle, head 32 strikes head stops (80, 82), pallet 74 is further lowered to a position to be moved out of the machine onto a conveyor (perhaps 2 inches), the head structure then moves back up, the pallet structure then assumes a position for the loading of another pallet, and the cycle is about ready to repeat. I have already observed that rotary valve 50 does not close until hydraulic stops 43 have had time to resume their original positions. I have previously noted, also, that during a run, adjustable flow valve 52 may be adjusted a number of times by the operator as he senses that adjustment is needed in order to maintain the degree of slump or roll of blocks desired, i.e., he observes less roll, more defects appear, the mix has become dryer, etc.

I have mentioned head stops for head assembly 32 and this is diagrammatically illustrated in FIG. 10. Stop portion 80 is attached to the stripper head assembly 32 and stop portion 82 is a fixed stop, i.e., it may be attached to the machine frame. When head assembly abutment 80 strikes stop 82, stripper shoes 30 are restrained from further downward movement when block 70 has been extruded from mold 12, and pallet 74 can descend to the conveyor level for delivery of the block, without being followed by shoes 30.

I have described the structure, method of operation, and process in the foregoing description. The process has been proved in production to provide a superior slumped block (more curvature or roll to walls) with a low rejection rate due to defects.

Some years back I used a collapsible hydraulic stop in a Columbia block machine. The relationships were generally similar, except for some structure such as no use of an accumulator in my prior apparatus, but the Columbia machine does not have a heavy head like the Besser and relies on hydraulic pressure rather than gravity to force the stripper head shoes through the mold. The results were uneven and I was not able to produce slump blocks with the generally good appearance, pronounced roll, and low rejection rate that I have achieved with the Besser machine. The difficulty seemed to be due to variations in hydraulic pressure in the Columbia machine, whereas in the Besser machine the head moves by force of gravity and thus always moves at the same speed in stripping and slumping, and the accumulator 48 always provides the same value of hydraulic pressure. I wish to point this out as I do not claim in my present invention the application of the structure and operation described to other than a machine in which the head strips blocks from molds under the force of gravity, and I want to make it clear that I made prior use of an apparatus and of a process generally similar to that disclosed herein except, as indicated, the Columbia machine stripped and slumped by hydraulic pressure and the same hydraulic source was used for the hydraulic stop that was used for stripping (which produced decidedly inferior results to the results with my present apparatus and process).

I claim:

1. In a machine making cement blocks having a mold with cores vertically aligned to receive a cementitious mixture to form a block shape in said cores, a stripper head located above said mold and having shoes adapted to move downardly through said cores to extrude said block shape from said cores, a pallet to receive said block shape, means supporting said pallet below said mold and means connected to said supporting means and operative therewith so as to cause said pallet to be moved from a first upper position substantially abutting the bottom of said mold such a distance as to support the lower surface of said block shape as it is extruded from said mold to a second lower position, said stripper head being free to move downwardly under force of gravity as said shoes extrude said block shape from said mold onto said descending pallet, am improvement in said machine to produce a slump block, comprising:

a. stop means between said stripper head and said means supporting said pallet operative to limit relative movement of said head toward said pallet during said movement of said pallet from said first to said second position, b. said stop means including a collapsible hydraulic stop and control means for said hydraulic stop operative to permit said shoes to descend relative to said pallet a selected limited distance as said shoes extrude said block shape from said mold whereby said shoes apply pressure to slump said block shape, c. a pressurized hydraulic accumulator and a line connecting said accumulator to said hydraulic stop thereby providing substantially constant hydraulic pressure to said hydraulic stop and said control means for said stop including flow control means interposed in said line so that the rate of collapse of said hydraulic stop is controlled by said flow control means as to the rate of flow through said line and the distance of said collapse is a function of the time available between the start of collapse and the end of the cycle of extruding said block shape and of the rate of flow permitted by said flow control means, d. said flow control means including a flow control valve and a manual control for said flow control valve that can be adjusted by an operator to control the rate of flow through said line during a block making run of said machine thereby to adjust slumping action according to changing conditions and observations of slumping results and e. an on-off valve assembly interposed in said line and on-off valve control means operatively connecting said pallet supporting means and said on-off valve assembly and activated by movement of said pallet supporting means, said on-off valve control means controlling the start of collapse of said hydraulic stop by when said on-off valve assembly is opened by said on-off valve control means.

2. In a machine making cement blocks having a mold with cores vertically aligned to receive a cementitious mixture to form a block shape in said cores, a stripper head located above said mold and having shoes adapted to move downwardly through said cores to extrude said block shape from said cores, a pallet to receive said block shape, means supporting said pallet below said mold and means connected to said supporting means and operative therewith so as to cause said pallet to be moved from a first upper position substantially abutting the bottom of said mold such a distance as to support the lower surface of said block shape as it is extruded from said mold to a second lower position, said stripper head being free to move downwardly under force of gravity as said shoes extrude said block shape from said mold onto said descending pallet, an improvement in said machine to produce a slump block, comprising:

a. stop means between said stripper head and said means supporting said pallet operative to limit relative movement of said head toward said pallet during said movement of said pallet from said first to said second position, b. said stop means including a collapsible hydraulic stop and control means for said hydraulic stop operative to permit said shoes to descend relative to said pallet a selected limited distance as said shoes extrude said block shape from said mold whereby said shoes apply pressure to slump said block shape, c. a pressurized hydraulic accumulator and a line connecting said accumulator to said hydraulic stop thereby providing substantially constant hydraulic pressure to said hydraulic stop and said control means for said stop including flow control means interposed in said line so that the rate of collapse of said hydraulic stop is controlled by said flow control means as to the rate of flow through said line and the distance of said collapse is a function of the time available between the start of collapse and the end of the cycle of extruding said block shape and of the rate of flow permitted by said flow control means, d. said flow control means including a flow control valve and a manual control for said flow control valve that can be adjusted by an operator to control the rate of flow through said line during a block making run of said machine thereby to adjust slumping action according to changing conditions and observations of slumping results and e. an on-off valve assembly interposed in said line and an on-off valve control means activated by movement of said pallet supporting means, said on-off valve control means being connected to said on-off valve assembly and controlling the start of collapse of said hydraulic stop by when said on-off valve assembly is opened by said on-off valve control means, f. said on-off valve assembly being comprised of a rotary valve and a valve arm attached thereto, said on-off valve control means comprising an arm attached to a shaft operatively connected with said pallet supporting means, said shaft arm rotating during movement of said pallet supporting means from said first position to said second position, and a link connecting said shaft arm and said valve arm whereby operation of said rotary valve between on and off positions is controlled by said shaft rotation.

* * * * *